US006434831B2

(12) United States Patent
Chen

(10) Patent No.: US 6,434,831 B2
(45) Date of Patent: Aug. 20, 2002

(54) FOLDING KNIFE WITH SAFETY FOR BLADE

(75) Inventor: Shun-fu Chen, Taipei Hsien (TW)

(73) Assignee: Chia Yi Ent. Co., Ltd., Taipei Hsien (TW)

( * ) Notice: Subject to any disclaimer, the term of this patent is extended or adjusted under 35 U.S.C. 154(b) by 81 days.

(21) Appl. No.: 09/757,425

(22) Filed: Jan. 11, 2001

Related U.S. Application Data

(63) Continuation-in-part of application No. 09/512,067, filed on Feb. 24, 2000, now Pat. No. 6,276,063.

(51) Int. Cl.[7] ..... B26B 1/04
(52) U.S. Cl. ..... 30/161; 30/155; 30/342
(58) Field of Search ..... 30/160, 161, 155, 30/153, 158, 159, 342

(56) References Cited

U.S. PATENT DOCUMENTS

| | | | | | |
|---|---|---|---|---|---|
| 4,750,267 | A | * | 6/1988 | Boyd | 30/161 |
| 5,596,808 | A | * | 1/1997 | Lake et al. | 30/160 |
| 5,615,484 | A | * | 4/1997 | Pittman | 30/155 |
| 5,772,168 | A | * | 6/1998 | Nakazawa et al. | 248/300 |
| 5,815,927 | A | * | 10/1998 | Collins | 30/155 |
| 5,979,065 | A | * | 11/1999 | Hsu | 30/161 |
| 6,154,965 | A | * | 12/2000 | Sakai | 30/160 |
| 6,212,779 | B1 | * | 4/2001 | Mitchell | 30/161 |
| 6,256,888 | B1 | * | 7/2001 | Shuen | 30/160 |
| 6,276,063 | B1 | * | 8/2001 | Chen | 30/155 |
| 6,363,615 | B1 | * | 4/2002 | Moser | 30/155 |
| 6,370,778 | B1 | * | 4/2002 | Conable | 30/160 |
| 6,378,214 | B1 | * | 4/2002 | Onion | 30/160 |

FOREIGN PATENT DOCUMENTS

| | | | | |
|---|---|---|---|---|
| DE | 454024 | * | 8/1925 | 30/161 |

* cited by examiner

*Primary Examiner*—M. Rachuba
*Assistant Examiner*—Jason Prone
(74) *Attorney, Agent, or Firm*—Rabin & Berdo, P.C.

(57) ABSTRACT

A folding knife with a safety for blade is provided. When a blade of the folding knife is in an extended position for use, a slip switch of the safety for blade could be moved to a safety lock position to depress a lock member for a lower rod portion of the latter to engage into a first locking hole on the blade, so that the blade would not turn back into a handle of the folding knife even when a blade lock of the knife is unexpectedly separated from the blade. And, when the slip switch is moved to the safety lock position when the blade is in a folded position in the handle, the lower rod portion of the lock member would engage into a second locking hole on the blade to prevent the blade from unexpectedly turning out of the handle.

18 Claims, 5 Drawing Sheets

FOLDING KNIFE WITH SAFETY FOR BLADE

This application is a continuation-in-part of U.S. patent application Ser. No. 09/512,067, filed Feb. 24, 2000, entitled "Folding Knife with Safety for Blade" now U.S. Pat. No. 6,276,063 B1.

FIELD OF THE INVENTION

The present invention relates to a folding knife with safety for blade, and more particularly to a folding knife with an improved safety for blade that does not increase the overall height of the folding knife and can be operated at reduced efforts to ensure a highly safe use of the folding knife.

BACKGROUND OF THE INVENTION

U.S. patent application Ser. No. 09/512,067 entitled "Folding Knife with Safety for Blade" filed by the same inventor of the present invention discloses a safety for blade provided at a first handle cover close to a pivot pin of the folding knife. The safety for blade mainly includes a slip switch, a push element, and an elastic element. The slip switch of the safety for blade is received in a recess formed on the first handle cover close to one side of a hole through which the pivot pin extends. There is a through hole provided in the recess for receiving the push element and the elastic element therein. The recess has an overall configuration matching with that of a top surface of the slip switch but is longer than the slip switch, so that the slip switch could be moved in the recess between a safety unlock and a safety lock position. The slip switch also has a pair of side walls downward extended from two sides of the top surface, such that when the slip switch is received in the recess, the side walls extend into two guide grooves provided at two sides of the recess for the slip switch to move in a direction defined by the guide grooves. Lower edges of the side walls form two hooking means that enable the whole slip switch to slide within the recess without separating therefrom. And, the top surface of the slip switch is provided at an underside with a downward projected protuberance. When the slip switch is moved to the safety lock position, the protuberance extends down into the through hole provided in the recess to interfere with the push element received in the through hole, forcing the push element to lower relative to the first handle cover.

An upper portion of the push element is provided at a top with an inward curved surface. When the slip switch is moved to the safety lock position, the protuberance interferes with the upper portion of the push element and engages a lower end with the inward curved surface, forcing the whole push element to move downward. At this point, a lower lock portion of the push element partially passes through a washer below it to engage into a locking hole formed on the blade to lock the blade in place.

A drawback of the above-described safety for blade is that the use of the push member results in a largely increased thickness of the folding knife that has adverse influence on a convenient operation of the knife. Moreover, when the slip switch is moved to the safety lock position and the protuberance interferes with the upper portion of the push element, there is a considerably large pressure area between the protuberance and the push element that results in increased-friction between these two elements and a user needs to apply increased force to operate the slip switch. It is even possible that the slip switch is stuck and could not be moved further. In the above-described safety for blade, the recess is also provided at a bottom surface with a round dent and the slip switch is provided at the underside with a projected small dot corresponding to the round dent, such that when the slip switch is moved to the safety unlock position, the small dot engages into the round dent to hold the slip switch in the safety unlock position. However, it appears the small dot does not always easily engage with the round dent to hold the slip switch in the safety unlock position and therefore causes inconvenience in the operation of the safety.

It is therefore tried by the inventor to make some modifications in the disclosure of the U.S. patent application Ser. No. 09/512,067 to enable the safety for blade of the folding knife to operate in a smooth manner.

SUMMARY OF THE INVENTION

A primary object of the present invention is to provide a folding knife with a safety for blade that does increase an overall height of the folding knife. To achieve this object, the safety for blade includes a lock member having a head portion with a beveled outer periphery and a push block having a beveled lower front, so that the lock member and the push block may be located at substantially the same horizontal plane to, on the one hand, shorten the height of the safety for blade, and on the other hand, allow the push block to smoothly push and depress the lock member to a position capable of locking the blade in place.

Another object of the present invention is to provide a folding knife with safety for blade, in which a push block having two notches provided at one side thereof and an elastic strip buried in a handle cover of the folding knife with a V-shaped projection extended toward the notches on the push block are included. When the push block is moved forward or backward to a safety lock position or a safety unlock position, the V-shaped projection of the elastic strip engages into one of the two notches to automatically hold the push block in place. Due to the elastic strip, a reduced frictional resistance of the V-shaped projection to the push block is possible when the projection engages into or disengages from the notches. The safety for blade can therefore be operated smoothly.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
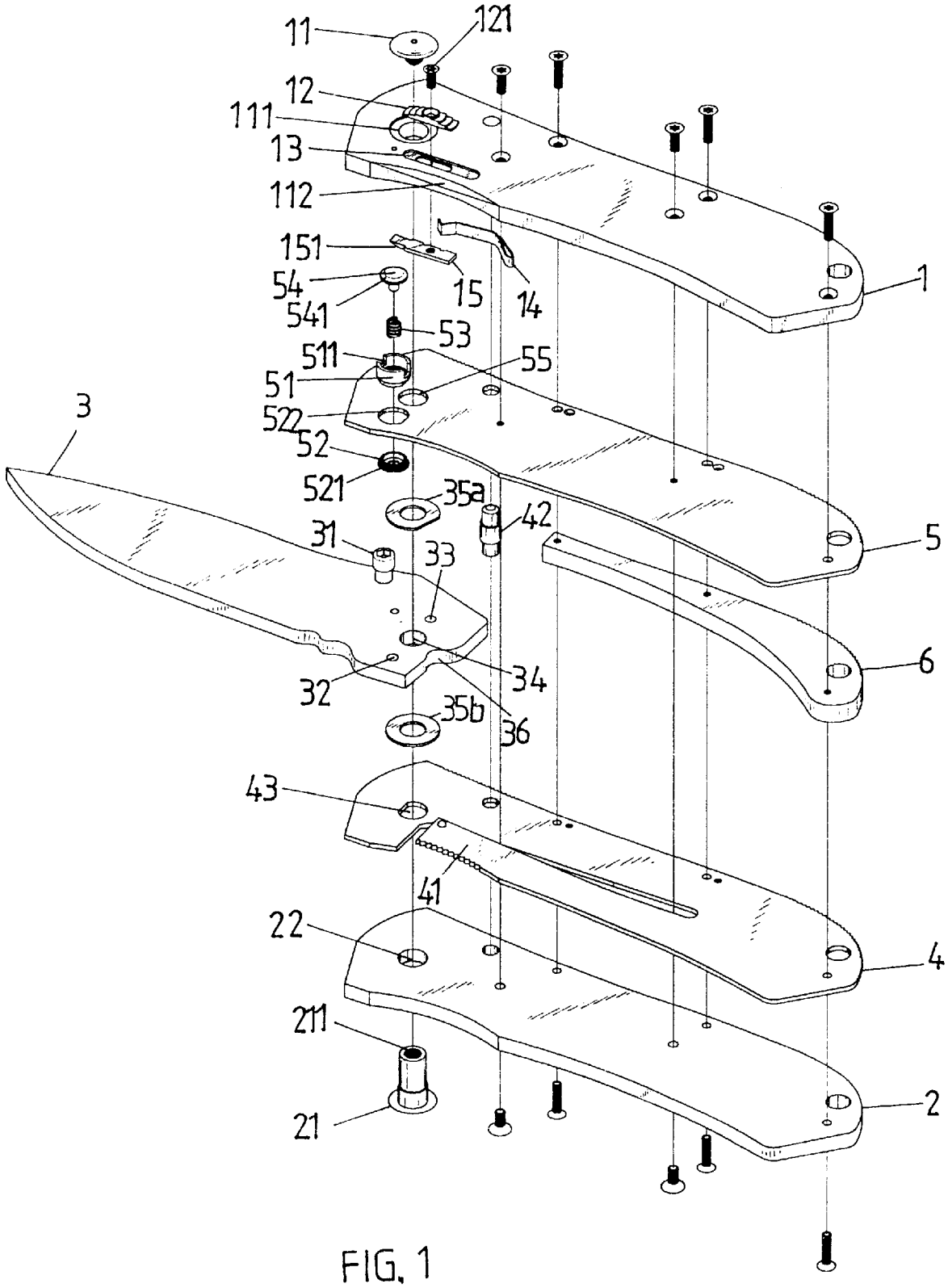
FIG. 1 is an exploded perspective of a folding knife with safety for blade according to the present invention.
Figure 3:
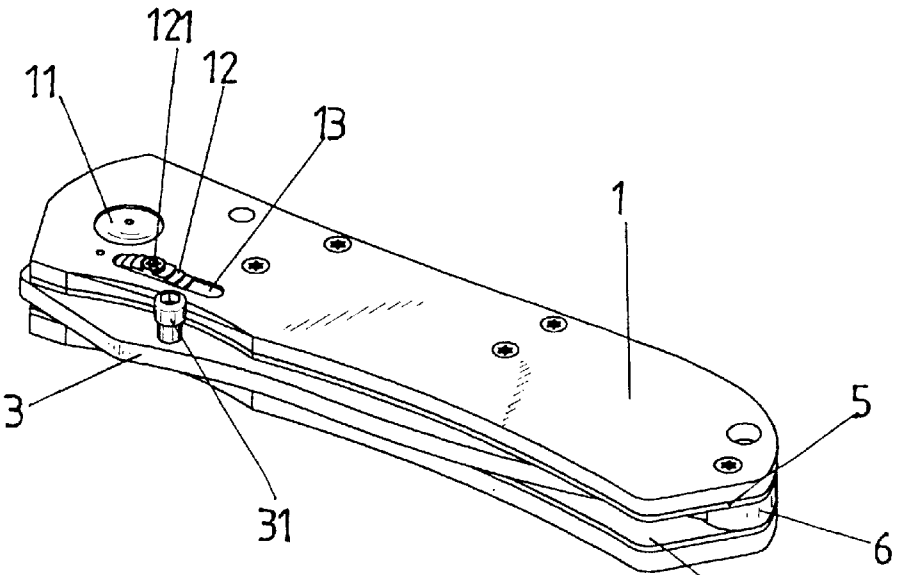
FIG. 3 is an assembled perspective of the folding knife of FIG. 1 with the blade thereof in a folded position.
Figure 2:
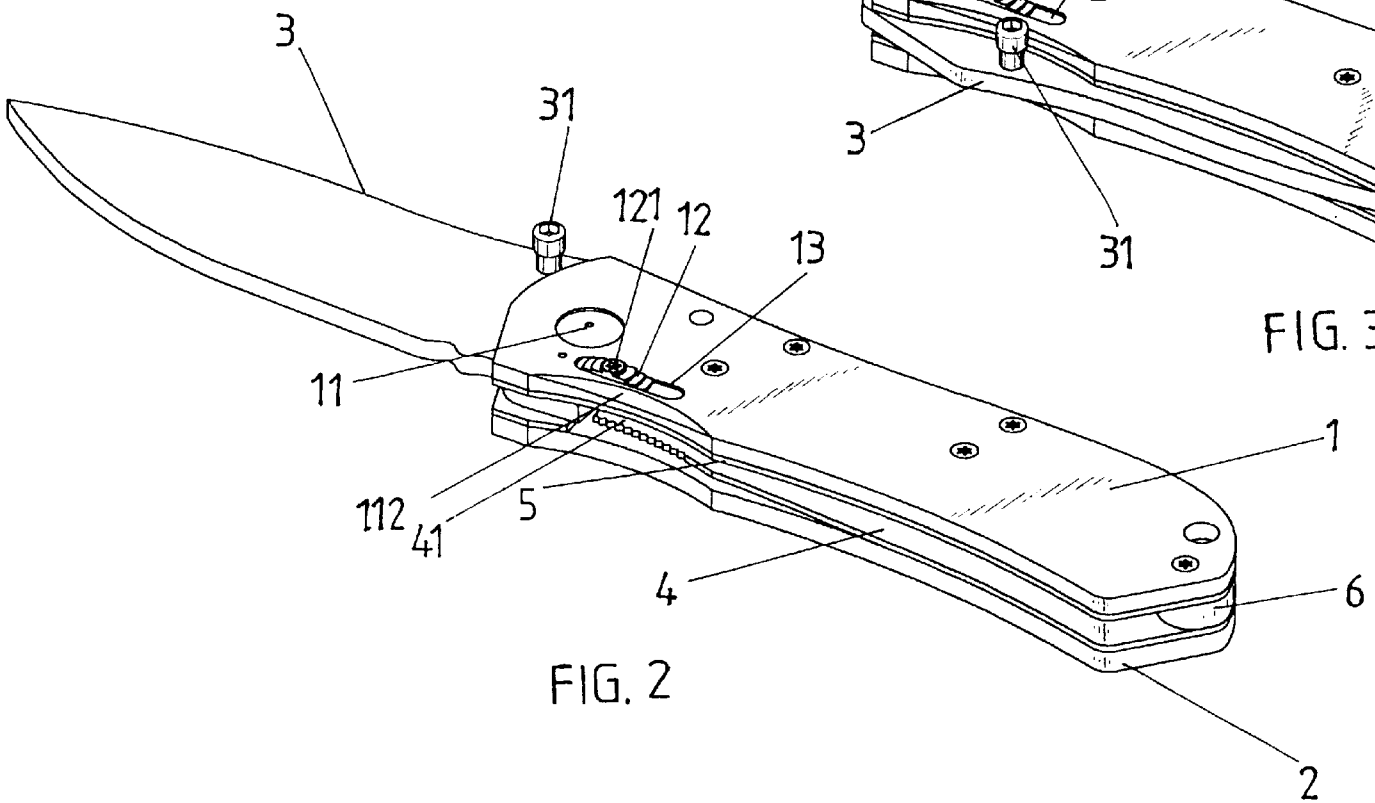
FIG. 2 is an assembled perspective of the folding knife of FIG. 1 with the blade thereof in an extended position.

Please refer to FIGS. 1, 2 and 3 in which a folding knife is illustrated as an example based on which the following description is made.

The folding knife mainly includes a handle composed of a first and a second handle cover 1 and 2, a blade 3 located between the first and the second handle covers 1 and 2, a blade lock 4 located between the blade 3 and an inner side of the second handle cover 2, a back-up plate 5 located between the blade 3 and an inner side of the first handle cover 1, and a back-up block 6 located between the back-up plate 5 and the blade lock 4. There is a pivot pin 21 upward extended in sequence through a first pin hole 22 formed near a front end of the second handle cover 2, a second pin hole 43 formed near a front end of the blade lock 4, a first washer 35*b*, a third pin hole 34 formed near a rear end of the blade 3, a second washer 35*a*, a fourth pin hole 55 formed near a front end of the back-up plate 5, and a fifth pin hole 111 formed near a front end of the first handle cover 1. A bolt 11 is downward screwed into an internally threaded central hole 211 of the pivot pin 21, such that the blade 3 is pivotally rotatably about the pivot pin 21. All the above-mentioned components of the folding knife are then tightened together with screws at predetermined positions. FIG. 2 is an assembled perspective of the folding knife of the present invention with the blade 3 in an extended position, and FIG. 3 is an assembled perspective of the folding knife of the present invention with the blade 3 in a folded position. When the blade 3 is in the extended position for use, as shown in FIG. 2, a leaf spring 41, that is integrally connected at an end to a main body of the blade lock 4 with a free end normally inclines toward the blade 3, presses its free end against a rear end surface 36 of the blade 3, firmly locking the blade 3 to the extended position. On the other hand, when the blade 3 is in the folded position, as shown in FIG. 3, a user may depress the leaf spring 41 via a cut 112 provided on one side of first handle cover 1, so that the leaf spring 41 is disengaged from the rear end surface 36 of the blade 3 to allow pivotal turning of the blade 3 about the pivot pin 21 to the folded position shown in FIG. 3.

Figure 4:
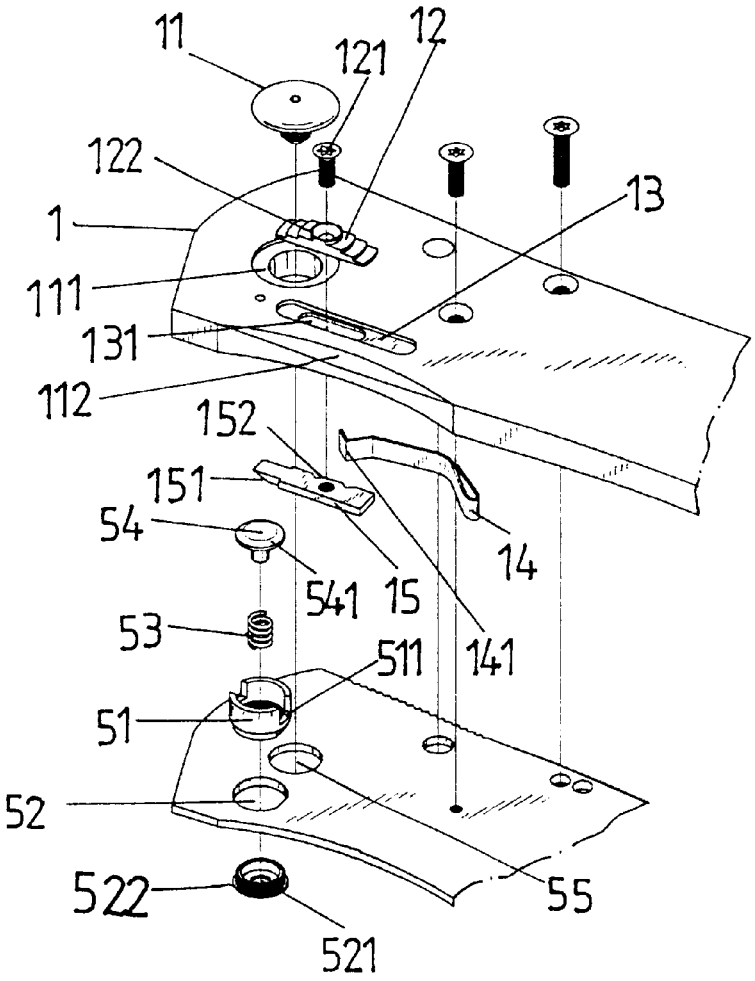
FIG. 4 is a fragmentary, enlarged, and partially exploded perspective of the folding knife of FIG. 1 showing the safety for blade thereof.
Figure 5:
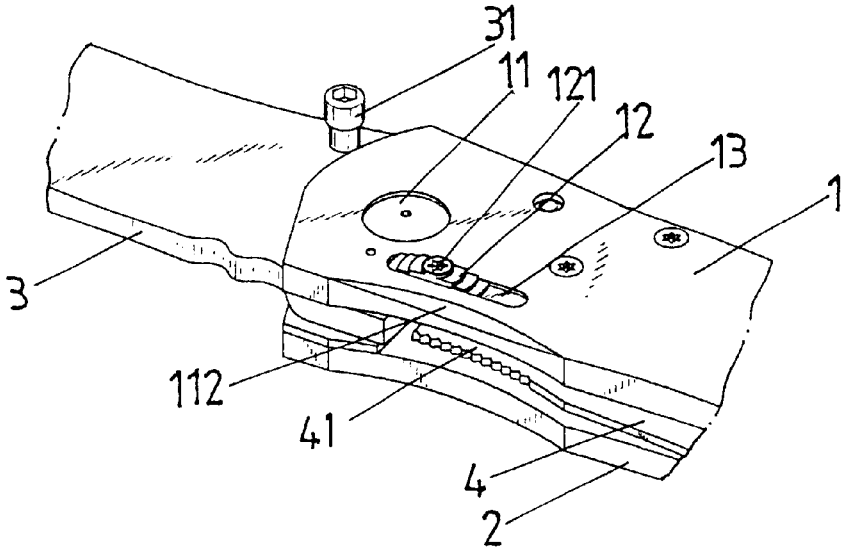
FIG. 5 is an enlarged and assembled perspective view of FIG. 4.

Please refer to FIGS. 4 and 5. The safety for blade according to the present invention is provided at the first handle cover 1 and the back-up plate 5 near the pivot pin 21. The safety for blade mainly includes a slip switch 12, a recess 13 provided on an outer surface of the first handle cover 1 close to the fifth pin hole 111, an elastic strip 14, an elongated push block 15, a receiving cylinder 51 disposed between the back-up plate 5 and the inner side of the first handle cover 1, a bottom cap 52, an elastic element 53, and a lock member 54.

The receiving cylinder 51 is provided on its peripheral wall with two diametrically opposite dents 511 and has a substantially D-shaped bottom outer periphery. The back-up plate 5 is provided with a substantially D-shaped through hole 522 corresponding to the D-shaped bottom of the receiving cylinder 51. The bottom of the receiving cylinder 51 is internally threaded and is adapted to extend through the hole 522 to engage with the externally threaded bottom cap 52 and thereby be fixed to the back-up plate 5. Due to the D-shaped bottom of -the receiving cylinder 51 and the D-shaped hole 522 on the back-up plate 5, the receiving cylinder 51 would not rotate in the hole 522 relative to the back-up plate 5.

The slip switch 12 is disposed in the recess 13 and is limited by the recess 13 to slide forward and backward only within the recess 13. A screw 121 is downward screwed through a small hole 122 on the slip switch 12 and a long through hole 131 in the recess 13 and into the push member 15, so that the push block 15 is fixedly connected to a lower side of the slip switch 12 and moves along with the slip switch 12. The receiving cylinder 51 is disposed in such a manner that the two opposite dents 511 are on the same line extended in a direction the same as the moving direction of the push block 15.

The push block 15 is provided at a lower front with a bevel surface 151, and at an inner side with two spaced notches 152. The elastic strip 14 is buried in the inner surface of the first handle cover 1 with a V-shaped projection 141 formed at a front end of the elastic strip 14 pointing toward the inner side of the push block 15, such that the V-shaped projection 141 of the elastic strip 14 automatically engages with one of the two notches 152 when the push block 15 is moved forward or backward by operating the slip switch 12, and thereby hold the push block 15 in the forward position or the backward position.

The lock member 54 includes a lower rod portion and an upper expanded head portion having a beveled outer periphery 541. The elastic member 53 is mounted around the lower rod portion of the lock member 54 before the latter is disposed in the receiving cylinder 51, and normally elastically pushes the lock member 54 to a high position in the receiving cylinder 51.

Figure 6:
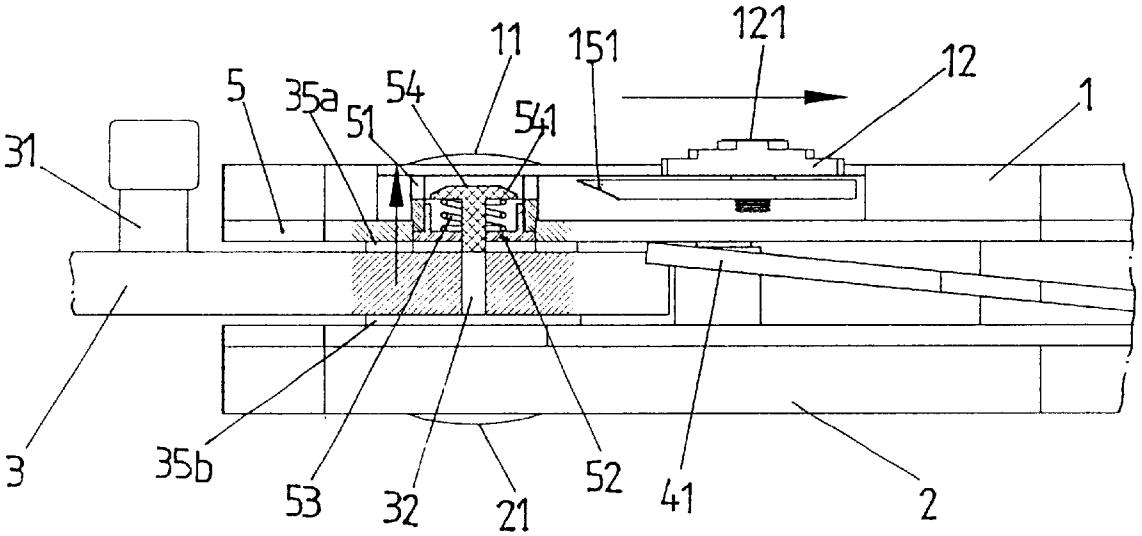
FIG. 6 shows a slip switch of the safety for blade of the present invention is moved to a safety unlock position.
Figure 7:
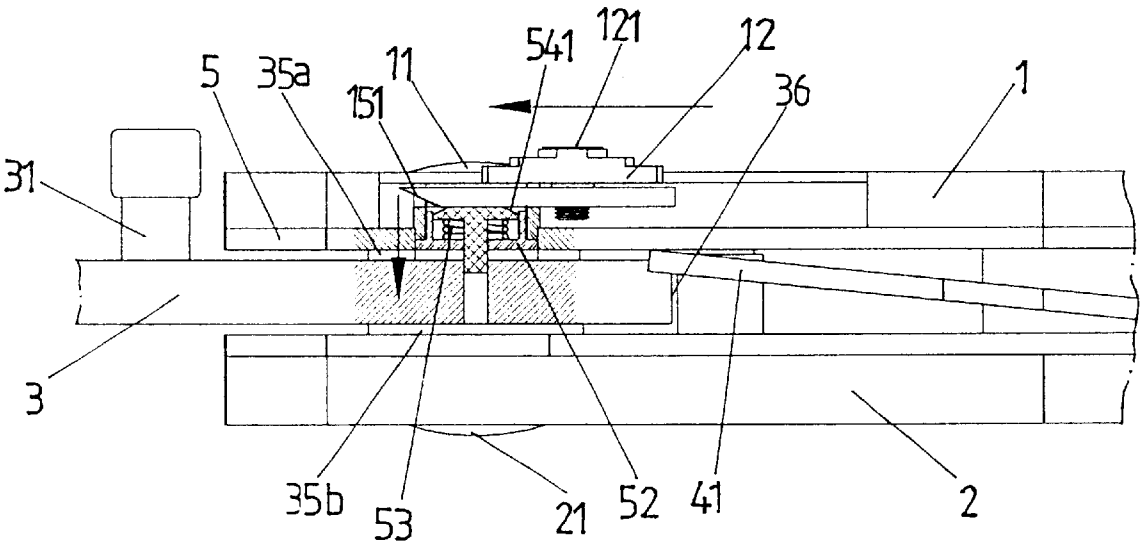
FIG. 7 shows the slip switch of the safety for blade of the present invention is moved to a safety lock position.

Please refer to FIGS. 6 and 7. The present invention is characterized in the bevel surface 151 of the push block 15 and the beveled outer periphery 541 of the lock member 54. When the slip switch 12 is pushed forward, as shown in FIG. 7, to bring the push block 15 to move forward along with it, the lower front bevel surface 151 of the push block 15 would get in contact with and shift along the beveled periphery 541 of the lock member 54 to allow the whole push block 15 to smoothly move to a top of the lock member 54 and elastically depress the lock member 54 to a low position in the receiving cylinder 51 due to an elasticity of the elastic member 53. At this point, the lower rod portion of the lock member 54 is moved down to extend through a central hole 521 of the bottom cap 52 and into a first locking hole 32 provided on the blade 3 near the rear end surface 36. The engagement of the lower rod portion of the lock member 54 with the first locking hole 32 ensures the blade 3 to locate at the extended position. And, the safety for blade of the present invention is now in a safety lock position.

On the other hand, when the slip switch 12 is pushed backward, as shown in FIG. 6, to bring the push block 15 to move backward along with it, the lock member 54 is no longer depressed by the push block 15 and is pushed upward by the elastic member 53 to the high position in the receiving cylinder 51, so that the lower rod portion of the lock member 54 disengages from the first locking hole 32 on the blade 3 to release the blade 3 from the intervention from the lock member 54. At this point, the safety for blade of the present invention is in a safety unlock position.

Figure 9:
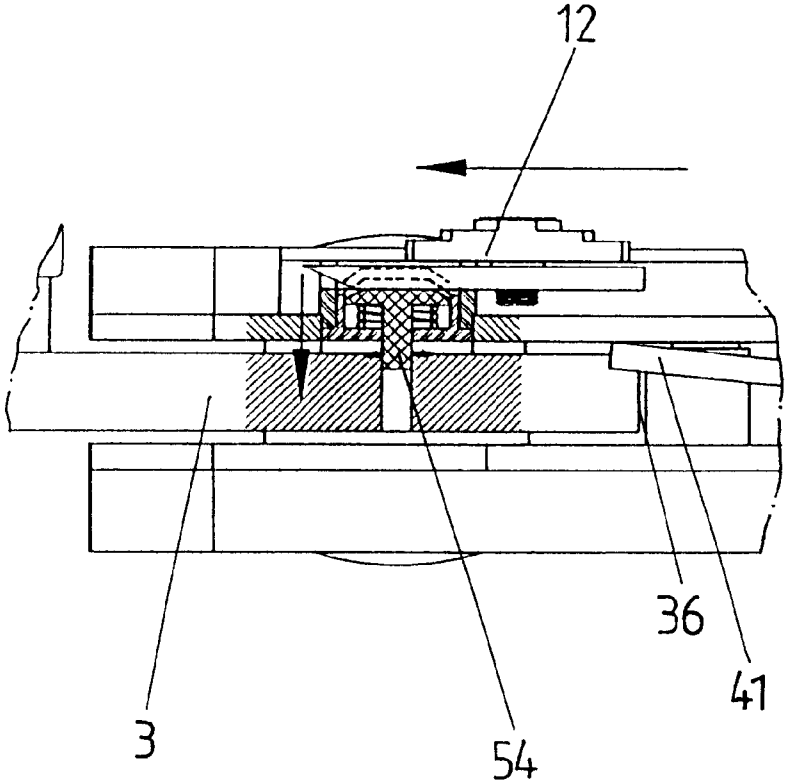
FIG. 9 shows in details the slip switch of the safety for blade of the present invention is moved to the safety lock position.
Figure 8:
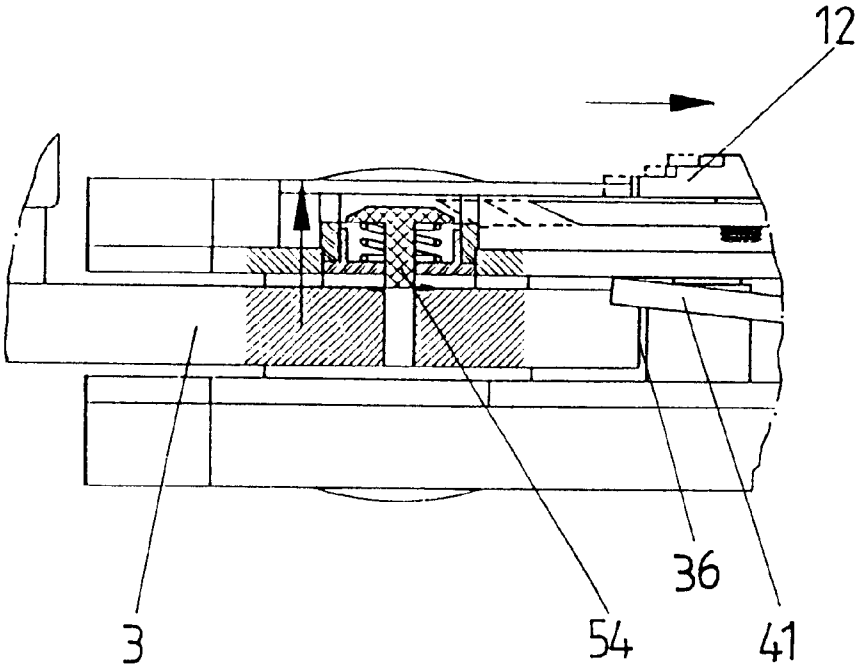
FIG. 8 shows in details the slip switch of the safety for blade of the present invention is moved to the safety unlock position.

FIGS. 8 and 9 correspond to FIGS. 6 and 7, respectively, to show in more details the operation of the slip switch 12 to the safety unlock and the safety lock positions, respectively.

When the blade 3 is turned into the folded position as shown in FIG. 3, a second locking hole 33 provided on the blade 3 opposite to the first locking hole 32 is just located below the lock member 54. A user needs only to push the slip switch 12 forward to the safety lock position as shown in FIGS. 7 and 9, the lower rod portion of the lock member 54 is moved down into the second locking hole 33 to lock the blade 3 in the folded position between the first and the second handle covers 1, 2. The blade 3 being locked in place by the engagement of the lock member 54 with the second locking hole 33 would not move out of the handle even the entire folding knife falls to the ground or is subjected to a strong impact against it. The back-up block 6 is a long member being fixedly located between the back-up plate 5 and the blade lock 4 to one side of them, so that a receiving space is provided between the back-up plate 5 and the blade lock 4 opposite to the back-up block 6 for receiving the blade 3 therein when the leaf spring 41 no longer presses h e rear end surface 36 of the blade 3 and the latter is turned into the folded position. A stop member 42 is also mounted between the back-up plate 5 and the blade lock 4 to prevent the blade 3 from being overly turned. A force-applying head 31 is provided on the blade 3 at a predetermined position close to the rear end surface 36 of the blade 3, so that the user may turn the blade 3 into or out of the handle of the folding knife with only one thumb.

The present invention is different from and superior to the U.S. patent application Ser. No. 09/512,067 in the beveled outer periphery 541 of the lock member 54 and the lower front bevel surface 151 of the slip switch 15 that allow shortened overall height of the safety for blade and permit the slip switch 15 to smoothly move forward while pushing the lock member 54 downward into the locking hole 32 or 33 on the blade 3 to lock the blade 3 in place.

What is claimed is:

1. A folding knife with safety for blade, comprising:

a folding knife that includes a handle composed of a first and a second handle cover, a blade located between said first and said second handle covers, a blade lock located between said blade and an inner side of said second handle cover, a back-up plate located between said blade and an inner side of said first handle cover, and a back-up block located between said back-up plate and said blade lock; a pivot pin being extended through pin holes provided on said first handle cover, said second handle cover, said back-up plate and said blade lock, such that said blade is pivotally turnable about said pivot pin between a folded position, in which said blade is received in a space defined between said first and said second handle covers to one side of said back-up block, and an extended position, in which said blade is ready for use; said blade lock including a leaf spring portion having a normally upward inclined free end, said free end of said leaf spring pressing against a rear end surface of said blade when said blade is in said extended position and thereby locking said blade in said extended position; and a downward force applied on said free end of said leaf spring being able to separate said leaf spring from said rear end surface of said blade and thereby allowing said blade to be pivotally turned into said folded position; and a safety for blade being provided on said first handle cover and said back-up plate near said pivot pin at a predetermined position, said safety for blade mainly including a slip switch that can be operated with one finger, an elongated push block connected to a lower side of said slip switch to move along with said slip switch and having a bevel surface provided at a front end of said push block, and a lock member having a lower rod portion and an upper expanded head portion that has a beveled outer periphery; said slip switch being movable between a safety lock position, in which said bevel surface of said push block gets into contact with said beveled outer periphery of said head portion of said lock member to push and depress said lock member for said lower rod portion thereof to extend into at least one locking hole provided on one side of said blade facing said first handle cover to prevent said blade from being pivotally turned, and a safety unlock position, in which said push block disengages from said lock member for said lower rod portion of said lock member to move out of said at least one locking hole on said blade and thereby allows said blade to be pivotally turned.

2. A folding knife with safety for blade as claimed in claim 1, wherein said blade is provided on one side facing said first handle cover with a first locking hole and a second locking hole, said lower rod portion of said lock member extending into said first locking hole when said slip switch is moved to said safety lock position with said blade located in said extended position, and said lower rod portion of said lock member extending into said second locking hole when said slip switch is moved to said safety lock position with said blade located in said folded position.

3. A folding knife with safety for blade as claimed in claim 1, wherein said slip switch is located in a recess provided on an outer surface of said first handle cover to move only within said recess between said safety lock position and said safety unlock position.

4. A folding knife with safety for blade as claimed in claim 3, wherein said recess is provided at a bottom with a long through hole via which said push block is connected to the bottom of said slip switch.

5. A folding knife with safety for blade as claimed in claim 1, wherein said push block is provided at one side with at least two cuts.

6. A folding knife with safety for blade as claimed in claim 5, wherein said cuts provided on said push block are V-shaped cuts.

7. A folding knife with safety for blade as claimed in claim 3, wherein said safety for blade includes an elastic strip that is buried in the inner surface of said first handle cover close to the bottom of said recess to automatically press an end against at least one of said two cuts at one side of said push block and thereby restricts said push block from moving.

8. A folding knife with safety for blade as claimed in claim 7, wherein said end of said elastic strip pressing against said cuts on said push block is a projection extended from said elastic strip toward said push block.

9. A folding knife with safety for blade as claimed in claim 8, wherein said projection on said elastic strip is a V-shaped projection.

10. A folding knife with safety for blade as claimed in claim 1, wherein said bevel surface on said push block is provided at a lower front of said push block.

11. A folding knife with safety for blade as claimed in claim 1, wherein said safety for blade further includes a receiving cylinder located in a hole provided on said back-up plate at predetermined position for receiving said lock member therein, a bottom cap connected to a bottom of said receiving cylinder, and an elastic member put around said lower rod portion of said lock member before being received in said receiving cylinder.

12. A folding knife with safety for blade as claimed in claim 11, wherein said receiving cylinder is provided on a peripheral wall with two diametrically opposite dents through which said push block passes when moving from said safety unlock position into said safety lock position.

13. A folding knife with safety for blade as claimed in claim 12, wherein said receiving cylinder has a D-shaped bottom outer periphery.

14. A folding knife with safety for blade as claimed in claim 13, wherein said receiving cylinder is provided around an inner lower wall surface with a screw thread.

15. A folding knife with safety for blade as claimed in claim 13, wherein said hole on said back-up plate into which said receiving cylinder is located is a D-shaped hole corresponding to said D-shaped bottom of said receiving cylinder.

16. A folding knife with safety for blade as claimed in claim 15, wherein said bottom cap is provided around an outer wall surface with a screw thread for meshing with said screw thread provided around the inner lower wall surface of said receiving cylinder, so that said receiving cylinder is fixed onto said back-up plate by screwing said bottom cap into said receiving cylinder.

17. A folding knife with safety for blade as claimed in claim 16, wherein said bottom cap is provided with a central hole through which said lower rod portion of said lock member is downward extended into said locking hole when said slip switch is moved to said safety lock position.

18. A folding knife with safety for blade as claimed in claim 4, wherein said slip switch and said push block are connected to each other by a screw threaded through a small hole on said slip switch and said long through hole in said recess into said push block.

* * * * *